US005470169A

United States Patent [19]

Verra

[11] Patent Number: 5,470,169

[45] Date of Patent: Nov. 28, 1995

[54] DEVICE FOR LOCKING A SLIDING BODY, AND PARTICULARLY A RETRACTABLE ROAD BOUNDARY MARK

[76] Inventor: Yvan Verra, 75, rue Folard, F-84310 Moriéres, France

[21] Appl. No.: 204,218

[22] PCT Filed: Aug. 27, 1992

[86] PCT No.: PCT/FR92/00825

§ 371 Date: Mar. 2, 1994

§ 102(e) Date: Mar. 2, 1994

[87] PCT Pub. No.: WO93/05235

PCT Pub. Date: Mar. 18, 1993

[30] Foreign Application Priority Data

Sep. 5, 1991 [FR] France ..... 91 11092

[51] Int. Cl.[6] ..... E01F 13/00

[52] U.S. Cl. ..... 404/6; 49/35

[58] Field of Search ..... 404/6, 9; 49/35, 49/49, 131; 70/389

[56] References Cited

U.S. PATENT DOCUMENTS 4,433,787 2/1984 Cook et al. ..... 70/389

FOREIGN PATENT DOCUMENTS 2581691 11/1986 France ..... 49/35

*Primary Examiner*—William P. Neuder

*Attorney, Agent, or Firm*—Harrison & Egbert

[57] ABSTRACT

A device for locking a sliding body, such as a retractable road boundary-mark, in at least two predetermined positions towards which the device is urged by a controller. The device includes a locking rod extending parallel to a sliding axis of the sliding body and rotatable about a longitudinal axis thereof. The locking rod has a plurality of transverse notches whose number and mutual distance along the rod are equal to the number and the mutual distance of the predetermined positions and which are angularly spaced from each other about the longitudinal axis of the rod.

8 Claims, 3 Drawing Sheets

FIG. 1C
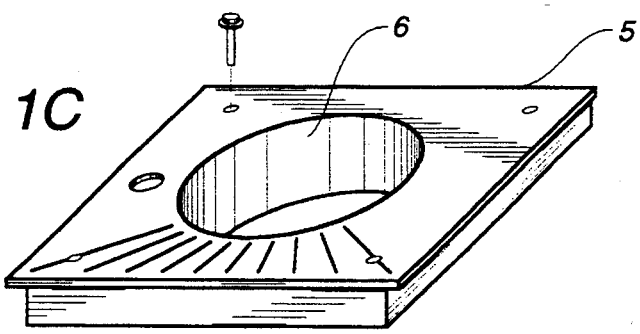
FIG. 1A
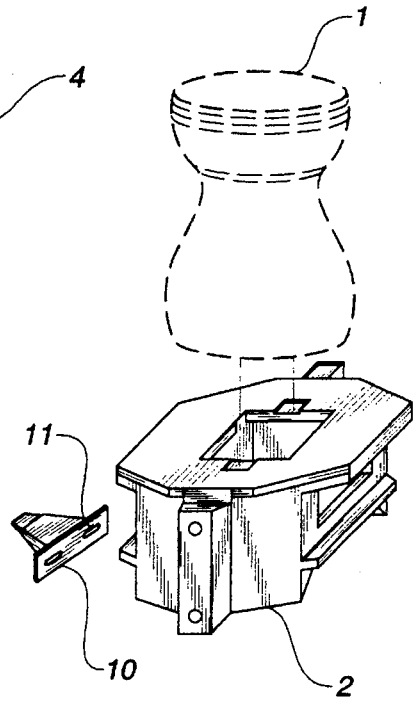
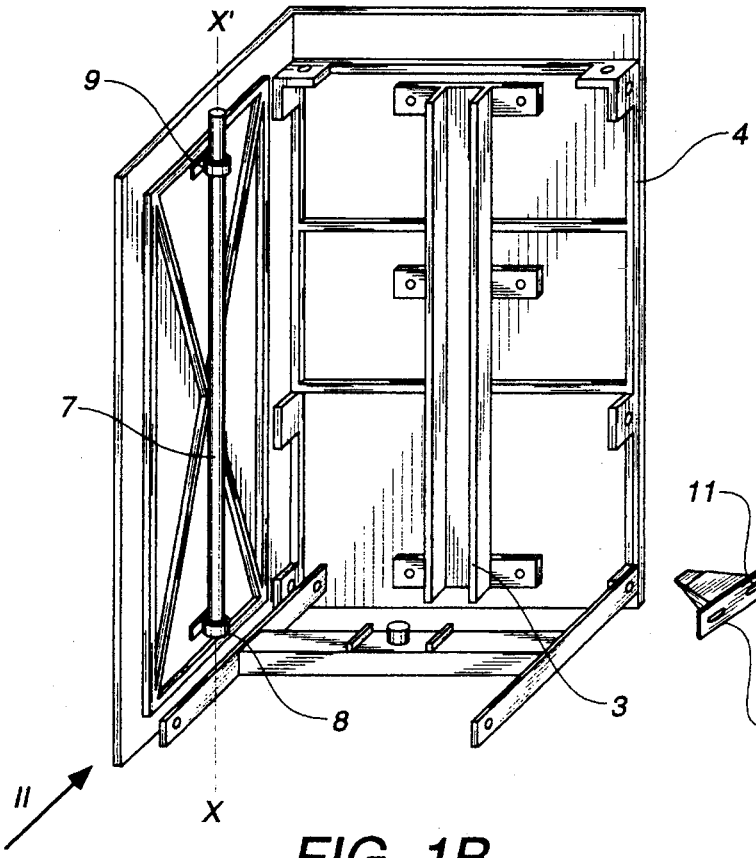
FIG. 1B

FIG. 5
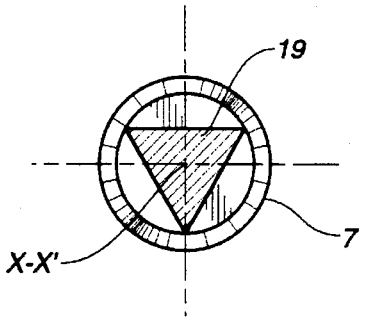
FIG. 6
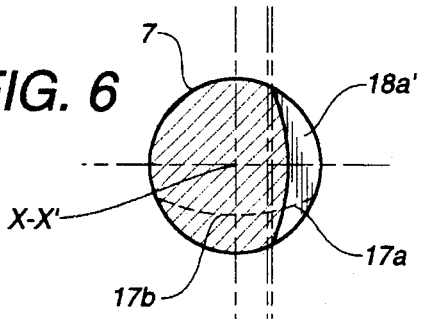
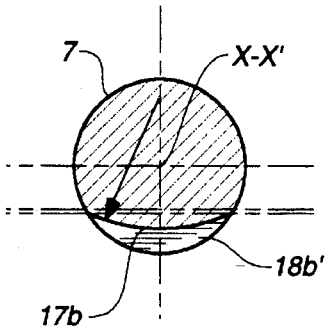
FIG. 7
FIG. 9
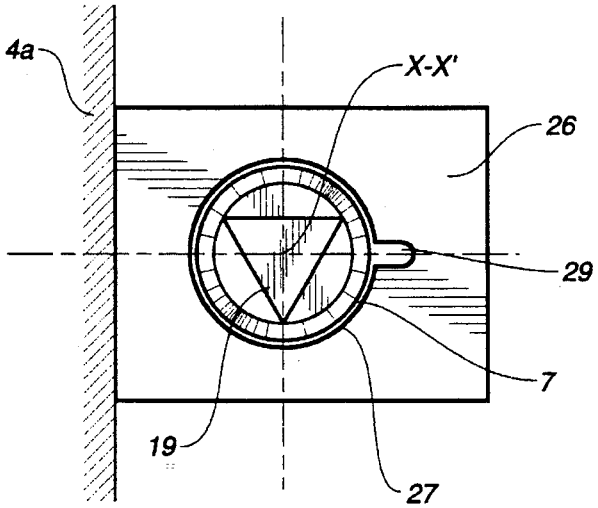
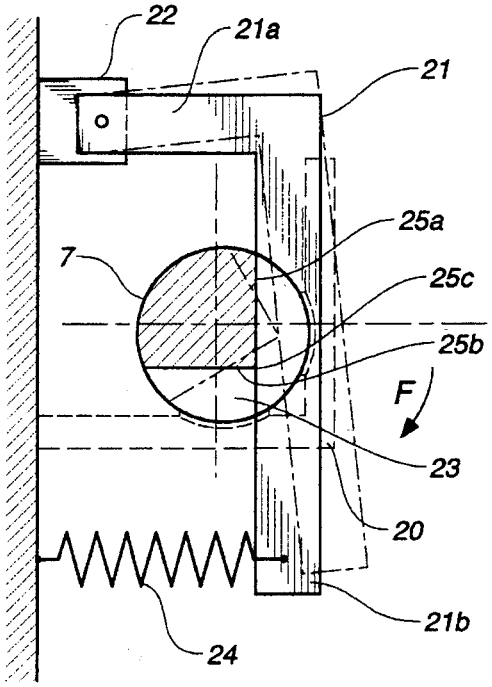
FIG. 8

DEVICE FOR LOCKING A SLIDING BODY, AND PARTICULARLY A RETRACTABLE ROAD BOUNDARY MARK

TECHNICAL FIELD

The present invention relates to a device for locking a sliding body, and more particularly a retractable road boundary-mark.

BACKGROUND ART

It is already known that the function of a boundary-mark consists in temporarily closing a space to vehicles while letting pedestrians cross when it is in its raised position or when it is protruding above the ground, and to enable authorized people to put their car in the space in question once the boundary-mark has been retracted into the ground by hand for example. Various systems for locking this kind of boundary-mark in a raised and/or a lowered position are already known, but they are not satisfactory particularly because they are not reliable enough, they are fragile and can be forced by hooligans, while another disadvantage arises from the fact that users may fail to put the boundary-mark back in its raised position once they have got over it.

The present invention therefore aims at providing a locking device of the above-mentioned type which overcomes the disadvantages of known systems and which is solid and reliable while being relatively inexpensive.

Another purpose of the invention is to provide a device which prevents the users from leaving the boundary-mark in its retracted position, that is in its lowered position once their car has gone over the device.

A further object is to protect such device from the harmful effect of outside agents such as surface waters, dust, sand and gravel.

SUMMARY OF THE INVENTION

According to the invention, the above and other aims which will appear hereinafter, such as the automatic elimination of backlash and wear, are achieved thanks to a device of the above-mentioned type characterized in that it comprises a locking rod which extends parallel to the sliding axis of the sliding body and which may rotate about its longitudinal axis, but cannot move parallel thereto, said locking rod presenting a plurality of transverse notches whose number and mutual distance along said locking rod are respectively equal to the number and the mutual distance of said predetermined positions of the sliding body whose bottom is convex and is linked with the side cylindrical surface of the locking rod, and which are angularly spaced from one another about the lengthwise axes of said locking rod when they are viewed from their axis direction, without two successive notches overlapping, and a device with a bolt attached to said sliding body and capable of being urged into said notches by means of a spring force; and means for rotating said locking rod around its axis so as to bring it successively into predetermined angular positions into which one of the transverse notches of the rod, viewed from the rod axis direction, opens outwardly in the direction of the bolt which is meant to enter into said notch.

It shall be easily understood that with such device, the bolt is pushed by a spring force into one of the notch of the locking rod according to the invention for each predetermined position of the sliding body, for example for the raised and the lowered positions in case of a retractable road boundary-mark. If said rod is then rotated, the contact point between the bottom of the convex notch and the bolt end goes away from the axis of the rod, and the bolt is outwardly driven as it slides on the bottom of the notch. Then there is a time when the bolt is no longer held back by the notch and when the it can slide along a generator of the cylindrical side surface of the locking rod, under the influence of the control unit which acts upon the sliding body until it meets the following notch of the rod into which it enters so as to be locked, a process which stops the sliding body attached to the bolt from moving.

According to one advantageous embodiment of the present invention, particularly concerning the machining of the locking rod, each notch of said rod is radially delimited by a bottom made of a cylindrical revolution surface whose axis, parallel with the locking rod, is placed between said axis and the side surface of the rod or beyond, and, axially by two plane shoulders perpendicular to the locking rod axis, said shoulders being crescent-shaped and extending from the arc of a circle of the locking rod cylindrical side surface and the arc of the cylindrical surface composing the bottom of the notch. For greater convenience, the imaginary straight line joining up both intersecting points of said arcs of a circle will be named "chord of the notch" in the following description.

In the most simple case where only two predetermined positions of the sliding body are provided, for example a low retracted position and a high protruding position of a retractable boundary-mark, the locking rod of the device according to the invention consists of two transverse notches which are for example offset according to a 90° angle when they are viewed from the rod axis direction. That means that it is a quarter turn rotation of the rod into one direction or the other which will enable a road boundary-mark to go from one notch to the other or vice versa, that is to say from the low position to the high position or conversely.

As for the above-mentioned bolt device, it advantageously comprises a guide roller installed on the sliding body perpendicularly with its sliding axis, the actual bolt which is assembled so that it can slide inside the guide roller and whose free end is dimensioned so as to be able to enter the transverse notches of the locking rod, a pressure spring inserted between the bottom of the guide roller and the actual bolt, and a catch which is solid with the bolt and slides in an elongated slot provided for in the side wall of the guide roller and which extends parallel to the axis thereof. It is understood that it is said pressure spring which is meant to push the free end of the bolt into the respective notches of the locking rod, whereas the catch cooperating with the elongated slot prevents the bolt from turning in its guide roller and delimits the axial stroke. It should also be noted that such solution makes it possible to eliminate backlash and wear of the bolt and the locking rod automatically, as well as to correct linearity faults of the rod, such faults being originated for example by the rod buckling.

Preferably, the abovementioned means rotating the locking rod around its axis comprise a prismatic tip which protrudes at one of the end of said rod and whose edges are parallel to the rod axis, and an operating key ended with a female hollow imprint reproducing the cross section of the shape of said prismatic tip. This tip having a triangular cross section for example, can be attached to the locking rod, but it can also be part of the cylinder which is assembled so as to be interchangeable on one of the end of the rod, so that the key can be easily and regularly changed, thereby preventing non authorized person from using the boundary-mark.

Advantageously, an access plate is fixedly placed beyond the prismatic tip of the locking rod perpendicularly to the axis of the latter, such access plate being provided with an opening in line with the rod, said opening being designed for the introduction of the operating key and having a shape which corresponds to that of the outline of the actual key. Therefore the locking rod can only be actuated with a key which corresponds to the key which is used, not only thanks to its inner shape but also to its outline. Besides, such access plate protects the locking device from the introduction of any forcing tool.

Moreover, according to one advantageous embodiment of the invention, if the outline of the operating key when it covers the prismatic tip of the locking rod is in line with the opening provided in the access plate for only one of the predetermined angular positions of the locking rod, and therefore of the sliding body, the key will only be withdrawn from the opening of the access plate if the locking rod has been previously placed in the predetermined position which allows this operation. As for a two-positions road boundary-mark, one should obviously choose as unique angular position enabling to withdraw the key the position which corresponds to the raised position of the boundary-mark so that the user will only be able to withdraw his key if he takes care to put the boundary-mark back in its raised position.

This advantageous characteristic of the various shapes which can be given to the imprint of the key and to its outline, together with the various possible angular relative positions of the locking rod and the access plate opening make it possible to multiply the conceivable confidentiality combinations endlessly, thereby providing a safety which is still unequalled today.

According to the invention, the device is advantageously protected against outside agents such as surface waters, dust and sand thanks to an automatic shutter which is situated above the locking rod at ground level.

Preferably, the locking rod according to the invention comprises a notch for holding and returning to an angular position whose bottom consists in a plurality of flat surfaces, each of them corresponding with one of the predetermined angular positions which is to be held, and extending into space parallel to the chord of the corresponding notch, and into which enters a L-shaped lever arm which returns to the bottom of the notch thanks to a spring, the other arm of said L-shaped lever being articulated on a fixed part. This type of locking mechanism holds the locking rod in each one of the angular positions corresponding with one of the predetermined positions of the sliding body as well as it returns it into the nearest position.

As for the controlling device of the sliding body motions, that is for example of the road boundary-mark, it could be the pneumatic mechanism which is described in the French patent 86 05310 dated Apr. 4 1986, but it could also be a plain spring which is pressed by pushing the boundary-mark so as to place it into its lowered position and which springs back when the locking device according to the invention allows the boundary-mark to return to its raised position.

It has been noted from what has been said so far that the solutions proposed by the present invention make it possible to reach the objectives which were aimed at.

The following description which is in no way aimed at limiting the invention, will enable to understand how the present invention may work.

BRIEF DESCRIPTION OF THE DRAWINGS

FIGS. 1 and 1*a* are an exploded perspective views of a road boundary-mark using the locking device according to the invention;

FIGS. 5 to 8 show cross-sections of the locking rod of FIG. 2, taken respectively along the lines V—V to VIII—VIII of the figure;

FIG. 9 shows a plate leading to the locking rod of the device according to the invention, taken along the line IX—IX of FIG. 2.

DETAILED DESCRIPTION OF THE INVENTION

Figure 2:
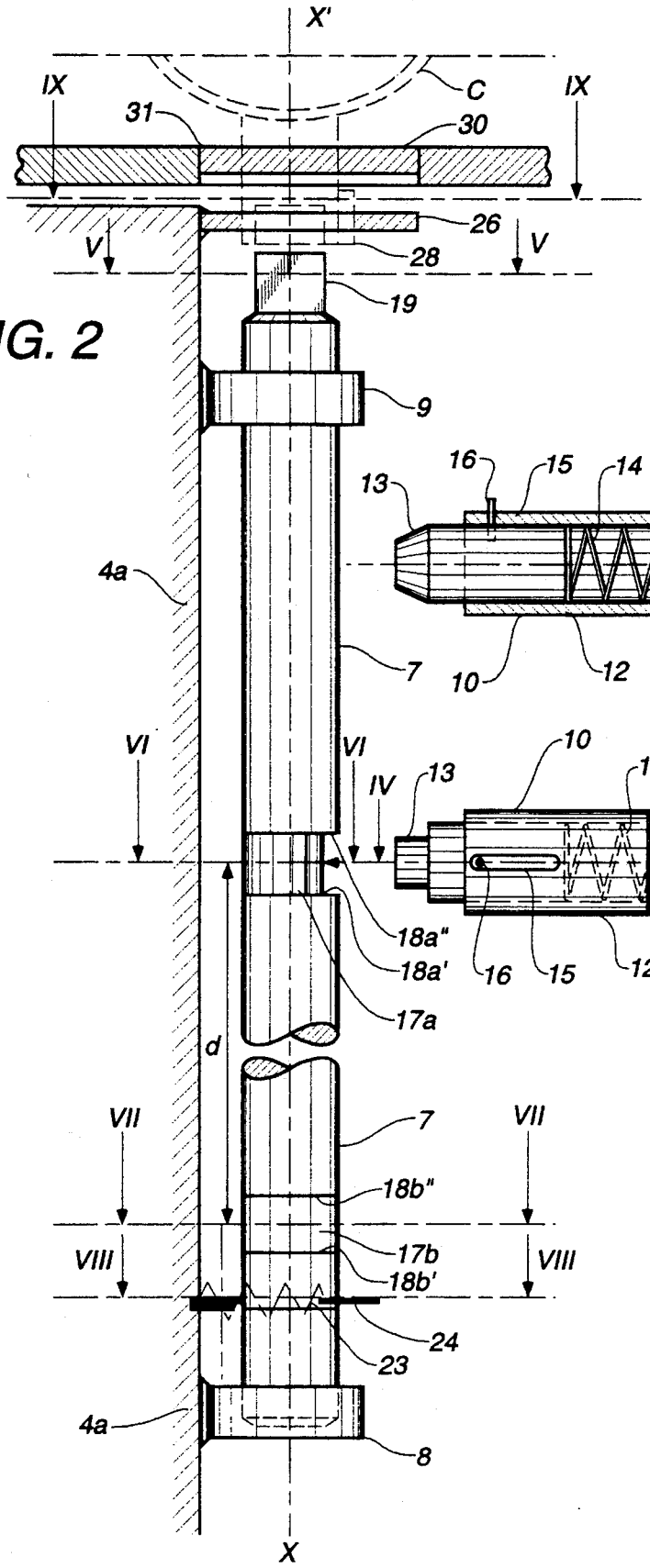
FIG. 2 shows a side sectional drawing of the locking rod of the device shown in FIG. 1, according to line II of such figure.
Figure 4:
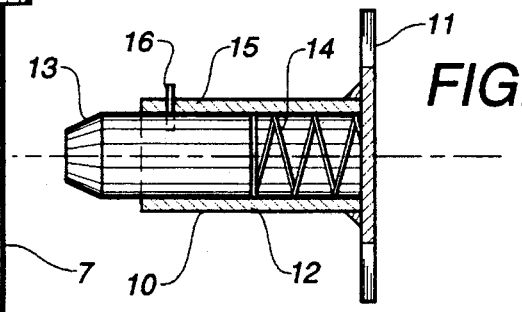
FIG. 4 is a cross-section of the bolt of FIG. 3 taken along line IV—IV.
Figure 3:
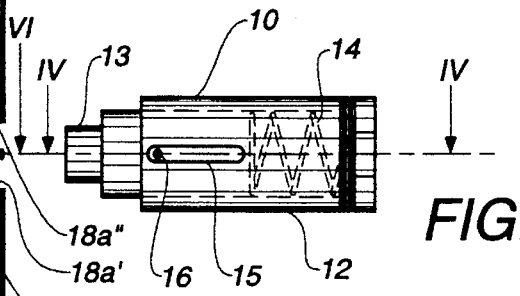
FIG. 3 as well as FIG. 4 shows the device with a bolt acting on the locking rod of the figure.

In order to explain the operating method of the locking device which has just been described, it is inferred that the retractable boundary-mark (1) and the slide unit (2) are in a raised position and that the angular position of the locking rod (7) is such as the upper notch (17*a*) of said rod is directed toward the bolt (13), as it is shown on the composition of FIGS. 2 and 3, so that the free end of the bolt enters thereto thanks to the spring (14). If one were to try to move the road boundary-mark (1) vertically, nothing would happen since the bolt (13) which is solid with the boundary-mark (1) thanks to the slide unit (2) and inserted into the notch (17*a*) of the rod (7) prevents the unit comprising the boundary-mark (1) and the slide unit (2) from moving vertically.

If the user then opens the door (30) and inserts the key into the opening (27) of the access plate (26), the female recession of said plate covers the prismatic tip (19) of the locking rod (7), as it has already been explained hereabove. Then, the user makes his key rotate by a quarter turn in the direction imposed by the stops (20) of the rod (7), and the mechanism consisting of the lever (21), the draw spring (24) and the flat surfaces (25) causes the rod (7) to go into the other extreme position. Meanwhile, the free end of the bolt (13) slides on the cylindrical bottom of the notch (17*a*) and the bolt (13) is pushed outside towards the spring (14). When it has completely come out of the notch (17*a*), the slide unit (2) can move freely downward thanks to its driving means which may consist of a manual pressure on the boundary-mark (1) towards a pressure spring, the free end of the bolt (13) sliding along one of the generators of the rod (7) until it enters the lower notch (17*b*) thanks to the spring (14), therefore locking the downward motion of the slide unit (2) and thus of the boundary-mark (1) which is then retracted. The unit consisting in the boundary-mark (1) and the slide unit (2) cannot move upward since the bolt (13) is caught into the notch (17*b*) of the locking rod (7).

Then the user may drive out, but if he carelessly leaves the boundary-mark in this position, he will not be able to get his key back since it is locked by its lateral snug (28) underneath the access plate (26), and he will only be able to take it off by turning it a quarter turn in the direction opposite to that transmitted to the key and therefore to the locking rod (7) by the prismatic tip (19). Simultaneously with this operation, the bolt (13) is pushed out of the lower notch (17*b*) of the rod (7), the free end of the bolt slides along one of the generators of the rod (7) thanks to the driving mechanism which tends to make the slide unit (2) and the boundary-mark (1) and therefore the bolt (13) attached to the latter go upward, and the bolt (13) is locked into the upper notch (17*a*) of the the rod (7) which is then on its way.

The user can take his key off, the snug of said key lining up with the lead-in notch (29) of the access plate (26) and the unit is back into its initial position where the boundary-mark (1) is projecting above the ground for obstructing the way. It is obvious that without departing from the present invention, many modifications may be made to the embodiment described hereabove. For example, this device could include more than two locking positions by providing an adequate number of notches (17) placed on precise points along the rod (7) and angularly offset so that once the bolt (13) has left one notch because of the rotation of the rod (7) and when it slides along one generator of the latter, it necessarily meets the notched into which it can be locked.

For a boundary-mark, it could be possible to provide positions offering several heights. Moreover, the prismatic end (19) which designed for being covered by the key C could be formed on an interchangeable cylinder and no longer be attached to with the rod (7). Besides, other means than squares (20) could be used so as to limit the rotating stroke of the locking rod (7) as, for example, a fixed finger entering into a ring groove provided for on 90° of the rod (7). The latter could be fixed into the case (4) thanks to other means than the step bearing (8) and the bearing (9) and, moreover, the opening (27) outline of the access plate (26) could be different from the one which is represented in FIG. 9. It will be noted that when there are more than two locking positions, the number of flat surfaces (25) provided for in the notch (23) of the rod (7) and designed for locking the rod into each one of the positions should be equal to the locking positions, each flat surface being parallel to the corresponding notch (17) chord.

I claim:

1. A device for locking a sliding body in at least two predetermined positions towards which the device may be urged by a control device acting on a locking body which extends parallel to a sliding axis of the sliding body and which rotates around its longitudinal axis but cannot move parallel thereto, the device comprising:

a plurality of transverse notches formed on the locking rod and whose number and mutual distance along said locking rod are respectively equal to a number and a mutual distance of said predetermined positions, said notches having a bottom which is convex and is linked with side surfaces of said locking rod, said notches being angularly spaced from each other about the axis of said locking rod when viewed from a lengthwise direction of the locking rod; and a bolt means cooperative with said plurality of transverse notches and attached to said sliding body, said bolt means engaging said notches by a pressure of a spring such that the rotating of said locking rod around its axis brings the bolt to the predetermined angular positions where one of said transverse notches opens outwardly toward said bolt means.

2. The device according to claim 1, each one of the transverse notches is radially delimited by a bottom configured as a cylindrical revolution surface whose radius exceeds a radius of the rod and whose axis parallel to the axis of said locking rod is situated between said axis and a lateral surface of the rod and two plane shoulders perpendicular to the axis of the locking rod.

3. The device according to claims 1, wherein two of said transverse notches being spaced by a 90° angle from each other when said two of said transverse notches are viewed from the lengthwise direction of said locking rod.

4. The device according to claim 1, wherein said bolt means comprises:

a guide roller fixed on said sliding body perpendicularly to the sliding axis of the sliding body;

a bolt member slidingly mounted inside said guide roller and whose free end is dimensioned so as to allow it to enter said transverse notches;

a pressure spring located between a bottom of said guide roller and said bolt member; and a catch integral with the bolt member and slidable in an elongated slot in a side wall of the guide roller.

5. The device of claim 1, further comprising:

a prismatic tip protruding from an end of the rod and having edges parallel to the axis of the rod; and an operating key having a female imprint matching a cross-section of a shape of said prismatic tip, said prismatic tip being part of a cylinder interchangably mounted to the end of the locking rod.

6. The device according to claim 5, wherein said operating key has an outline in line with an opening of said access plate for only one given angular position of said locking rod when said operating key covers said prismatic tip.

7. The device according to claim 1, said sliding body being a retractable road boundary-mark, the device further comprising:

an automatically closing protection door positioned at generally ground level above said locking rod.

8. The device according to claim 1, further comprising:

a notch means for holding and returning to an angular position, said notch means having a bottom formed of a plurality of flat surfaces, each of said plurality of flat surfaces corresponding with one of said predetermined angular positions and extending parallel to a chord of a corresponding transverse notch, said notch means receiving an arm of a lever which resiliently returns to the bottom of said notch means.

* * * * *